US006092991A

United States Patent [19]

Tomita et al.

[11] Patent Number: 6,092,991

[45] **Date of Patent: *Jul. 25, 2000**

[54] GAS TURBINE BLADE

[75] Inventors: Yasuoki Tomita; Taku Ichiryu; Kiyoshi Suenaga, all of Hyogo-ken, Japan

[73] Assignee: Mitsubishi Heavy Industries, Ltd., Tokyo, Japan

[ * ] Notice: This patent is subject to a terminal disclaimer.

[21] Appl. No.: 09/035,500

[22] Filed: Mar. 5, 1998

[51] Int. Cl.[7] ..... F01D 5/18

[52] U.S. Cl. ..... 416/96 R; 415/114; 415/115

[58] Field of Search ..... 415/114, 115, 415/116, 117; 416/95, 96 R, 96 A, 97 R; 60/39.75

[56] References Cited

U.S. PATENT DOCUMENTS

| | | | |
|---|---|---|---|
| 3,455,537 | 7/1969 | Kozlin et al. | 416/96 R |
| 3,628,880 | 12/1971 | Smuland et al. | 415/115 |
| 4,353,679 | 10/1982 | Hauser | 415/115 |
| 5,320,485 | 6/1994 | Bourguignon et al. | 415/115 |
| 5,344,283 | 9/1994 | Magowan et al. | 415/115 |
| 5,413,458 | 5/1995 | Calderbank | 415/115 |
| 5,545,002 | 8/1996 | Bourguignon et al. | 415/115 |
| 5,639,216 | 6/1997 | McLaurin et al. | 416/95 |
| 5,813,835 | 9/1998 | Corsmeier et al. | 416/97 R |
| 5,829,245 | 11/1998 | McQuiggan et al. | 60/39.75 |
| 5,848,876 | 12/1998 | Tomita | 416/96 R |
| 5,873,695 | 2/1999 | Takeishi et al. | 415/115 |
| 5,915,923 | 6/1999 | Tomita et al. | 416/96 R |

FOREIGN PATENT DOCUMENTS

| | | | |
|---|---|---|---|
| 837469 | 6/1960 | United Kingdom | 416/95 |
| 846279 | 8/1960 | United Kingdom | 416/97 R |

*Primary Examiner*—Christopher Verdier
*Attorney, Agent, or Firm*—John P. White; Cooper & Dunham LLP

[57] ABSTRACT

A gas turbine blade having a platform and a turbine wheel plate, in which cooling passages are arranged in a plurality of rows and connected to one another in a blade trunk section of a moving blade and a supply-side passage and a discharge-side passage are formed in a blade root section. The gas turbine blade comprises a pocket having an inlet and an outlet formed in the blade root section. The supply-side passage is connected to one of the cooling passages and the inlet of the pocket, the outlet of the pocket is connected to another of the cooling passages, and the discharge-side passage is connected to one of the cooling passages other than the ones connected individually to the supply-side passage and the pocket.

11 Claims, 3 Drawing Sheets

GAS TURBINE BLADE

BACKGROUND OF THE INVENTION

The present invention relates to a gas turbine blade, in which a blade trunk section of a moving blade is formed having cooling passages arranged in a plurality of rows, through which a cooling medium is run in the span direction, and a blade root section is formed having a supply-side passage connected to the cooling passages so as to be able to supply the cooling medium thereto and a discharge-side passage through which the cooling medium circulated through the cooling passages is discharged.

In some of modern moving blades used in gas turbines with high turbine inlet temperature, a plurality of rows of passages are arranged in the span direction in the moving blade, and low-temperature compressed air is circulated through the passages so that moving blade can be cooled inside. According to these moving blades, which are exposed to high-temperature gas, their temperature can be restricted to a value not higher than an allowable value that is lower than a moving blade metal temperature and high enough to maintain good structural strength.

In cooling one such moving blade, cooling air supplied thereto cools it inside by convection as it passes through the cooling passages. Further, the cooling air is discharged into the high-temperature gas, which flow outside the blade, through holes in the leading edge portion, blade tip section, or trailing edge portion that is easily heated to high temperature on account of the structural conditions of the moving blade. In this manner, the edge or tip section is subjected to film cooling.

FIG. 1 is a vertical sectional view of a gas turbine blade with one such moving blade cooled by means of cooling air. As shown in FIG. 1, cooling passages 5 are formed in a blade trunk section 4 of a moving blade 1 so as to extend in the span direction between a blade root section 2 and a blade tip section 3. The passages 5 are arranged in a plurality of rows in the chord direction or the transverse direction of the blade 1, and are planted in the outer peripheral surface of the blade root section 2.

In this arrangement, cooling air 6 from an air passage in a rotor (not shown) introduced through a supply-side passage 10 in the blade root section 2 is caused to pass in the span direction between the root section 2 and the blade tip section 3, thereby subjecting the moving blade 1 to internal convection cooling.

After subjecting the moving blade 1 to the convection cooling, some of the cooling air 6 introduced through the supply-side passage 10 is discharged at high speed into a high-temperature gas 13, which flows around the blade 1, through apertures 7 that are bored through a leading edge portion 11 of the blade 1, thereby film-cooling the blade trunk section 4.

After cooling a trailing edge portion 12 of the moving blade 1 by convection, moreover, some of the cooling air 6 is discharged into the high-temperature gas 13 through holes 8 in the trailing edge portion 12 and aperture portions 9 in the blade tip section 3.

In FIG. 1, turbulators 14 are arranged in the cooling passages 5 so as to cross the flow of the cooling air 6, and serve to make the airflow turbulent, thereby improving the cooling efficiency.

Thus, in the conventional gas turbine blade, various cooling structures are used to enhance the cooling effect. Further, the structural strength is maintained by preventing intensive heating of those portions of the moving blade 1 which are thin and low in structural strength and high-temperature strength. By doing this, the operating efficiency of the operating efficiency of the moving blade 1 can prevented from lowering.

These days, moreover, a higher-temperature gas is expected to be used as an operating gas in order to improve the thermal efficiency of the gas turbine. To attain this, the material used should be higher in high-temperature strength, and the cooling effect for the moving blade must be enhanced.

Thus, a satisfactory cooling effect cannot be obtained with use of the aforesaid compressed air as the cooling medium, so that it is necessary to use steam as a cooling medium that ensures a large thermal capacity and high cooling efficiency.

With use of the gas turbine blade in which the moving blade 1 is cooled by means of the steam circulated therein, however, the thermal efficiency of the gas turbine is considerably lowered when the steam used for cooling, like the aforesaid cooling air 6, is discharged into the high-temperature gas 13. It is necessary, therefore, to recover all the steam used for cooling from the inside space of the moving blade 1 and collect the heat energy of the recovered steam by means of a steam turbine.

In consequence, in the case where the steam, like the cooling air 6, is discharged into the high-temperature gas 13, the temperature of the gas 13 is lowered considerably, and the internal efficiency of the turbine is lowered substantially. Besides, the heat energy recovered during the moving blade cooling operation cannot be utilized for the improvement of the thermal efficiency of the gas turbine. In the case where the steam is discharged into the high-temperature gas 13, therefore, the intended improvement of the thermal efficiency cannot be achieved.

Thus, the steam cooling resembles the aforesaid air cooling in that the blade root section 2 is provided with the supply-side passage through which the necessary quantity of steam for cooling is supplied to the supplied to the cooling passages 5. In the case of the steam cooling, however, low temperature steam must be fed to regions near the leading and trailing edge portions 11 and 12 of the moving blade 1 that are poor in high-temperature strength. It is necessary, therefore, to provide the supply-side passage in each of the leading and trailing edge portions 11 and 12. Moreover, the blade root section 2 should be provided with a discharge-side passage through which the steam used for cooling is discharged from the cooling passages.

In the case of the steam cooling, after all, the supply-side passage must be provided in each of those parts of the blade root section 2 which are situated close to the leading and trailing edge portions 11 and 12 of the moving blade 1, individually, in order to supply the low-temperature steam to the cooling passages in the edge portions 11 and 12. For the steam cooling, moreover, the blade root section 2 should be provided with a discharge-side passage between the supply-side passages, for discharging the steam from the cooling passage near the central portion of the moving blade 1. This discharge-side passage is used to recover the steam that is heated as it passes through the cooling passages.

Thus, for the steam cooling, the small-capacity blade root section 2 must be formed internally having the two supply-side passages, whose flow area for steam is larger than that for air, and the one discharge-side passage between them, and this is a hard task.

BRIEF SUMMARY OF THE INVENTION

The object of the present invention is to provide a gas turbine blade designed so that a cooling medium is supplied simultaneously to cooling passages in the leading and trailing edge portions of a blade root section.

The above object is achieved by a gas turbine blade constructed as follows. The gas turbine blade has a platform and a turbine wheel plate. In this gas turbine blade, cooling passages are arranged in a plurality of rows and connected to one another in a blade trunk section of a moving blade, and a supply-side passage and a discharge-side passage are formed in a blade root section. The gas turbine blade comprises a pocket having an inlet and an outlet formed in the blade root section, the supply-side passage being connected to one of the cooling passages and the inlet of the pocket, the outlet of the pocket being connected to another of the cooling passages, and the discharge-side passage being connected to one of the cooling passages other than the ones connected individually to the supply-side passage and the pocket.

Thus, a low-temperature cooling medium is first supplied from the supply-side passage of the blade root section to the leading and trailing edge sides directly or through the pocket. Accordingly, the leading and trailing edge portions, which are poor in structural strength, can be prevented from being heated to high temperature, so that a higher-temperature gas can be used as an operating gas, and the thermal efficiency of the gas turbine can be increased.

Further, the cooling medium supplied to the cooling passages can be recovered outside the moving blade from the central portion that is subjected to a relatively low cooling load after internally cooling the moving blade. Accordingly, there is no possibility of a high-temperature operating gas being cooled by being discharged into a high-temperature gas, and power can be generated superfluously by means of heat energy accumulated in the cooling medium by cooling. Thus, the thermal efficiency of the gas turbine can be further improved.

Furthermore, the blade root section is provided with internally with only one supply-side passage, and the cooling medium is distributed to the leading and trailing edge sides by means of the pocket that is provided on the outer surface of the blade root section. Therefore, the small-capacity blade root section can easily be internally furnished with the discharge-side passage and the supply-side passage through which passes steam that requires a larger flow area.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of a gas turbine blade according to the present invention will now be described with reference to the accompanying drawings.

Figure 2:
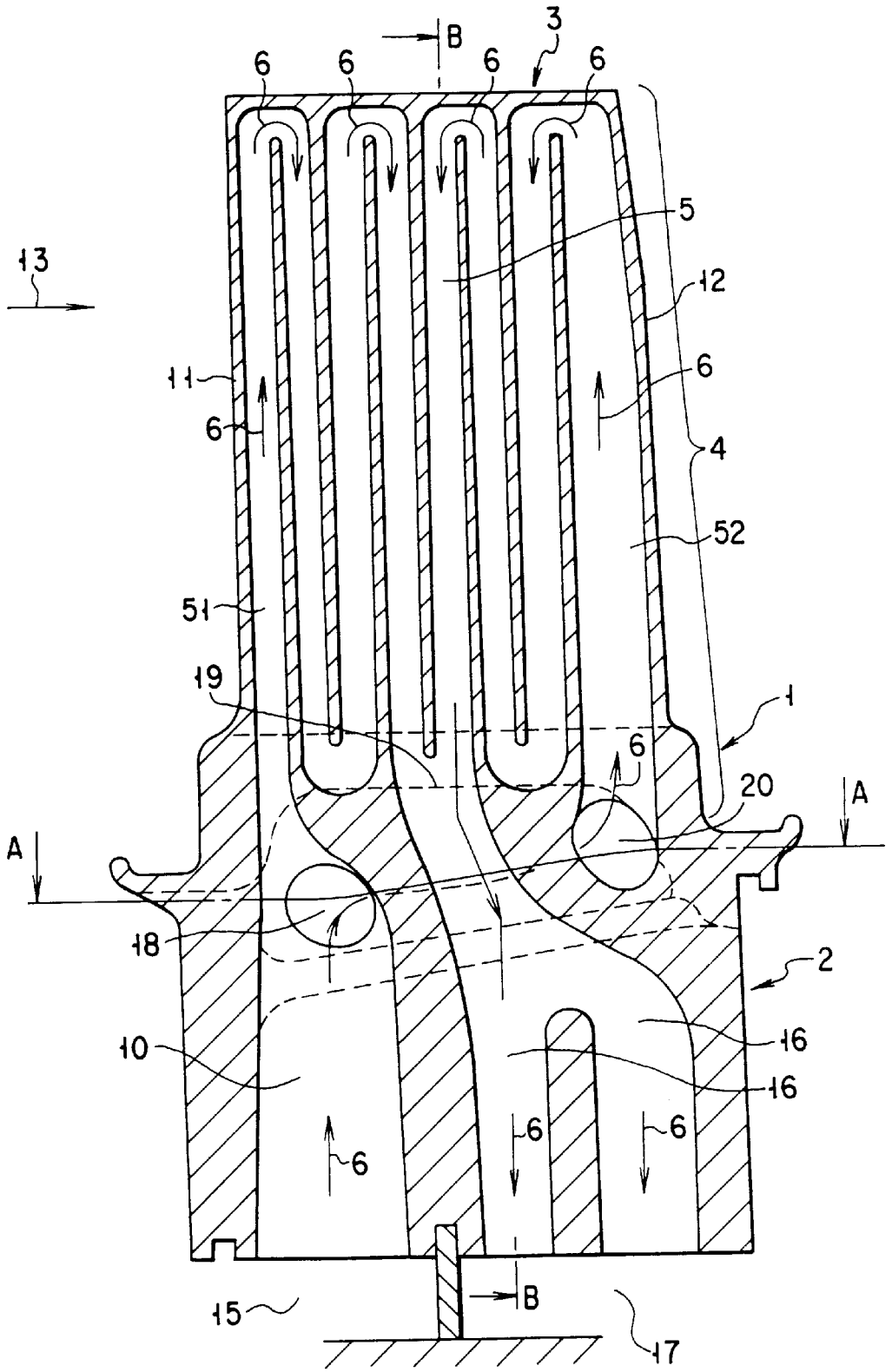
FIG. 2 is a vertical sectional view showing an embodiment of a gas turbine blade according to the present invention.

As shown in FIG. 2, cooling passages 5 are provided in a blade trunk section 4 of a moving blade 1 so as to extend in the span direction. Steam 6 is passed through the passages 5 to cool the blade 1 inside.

Figure 1:
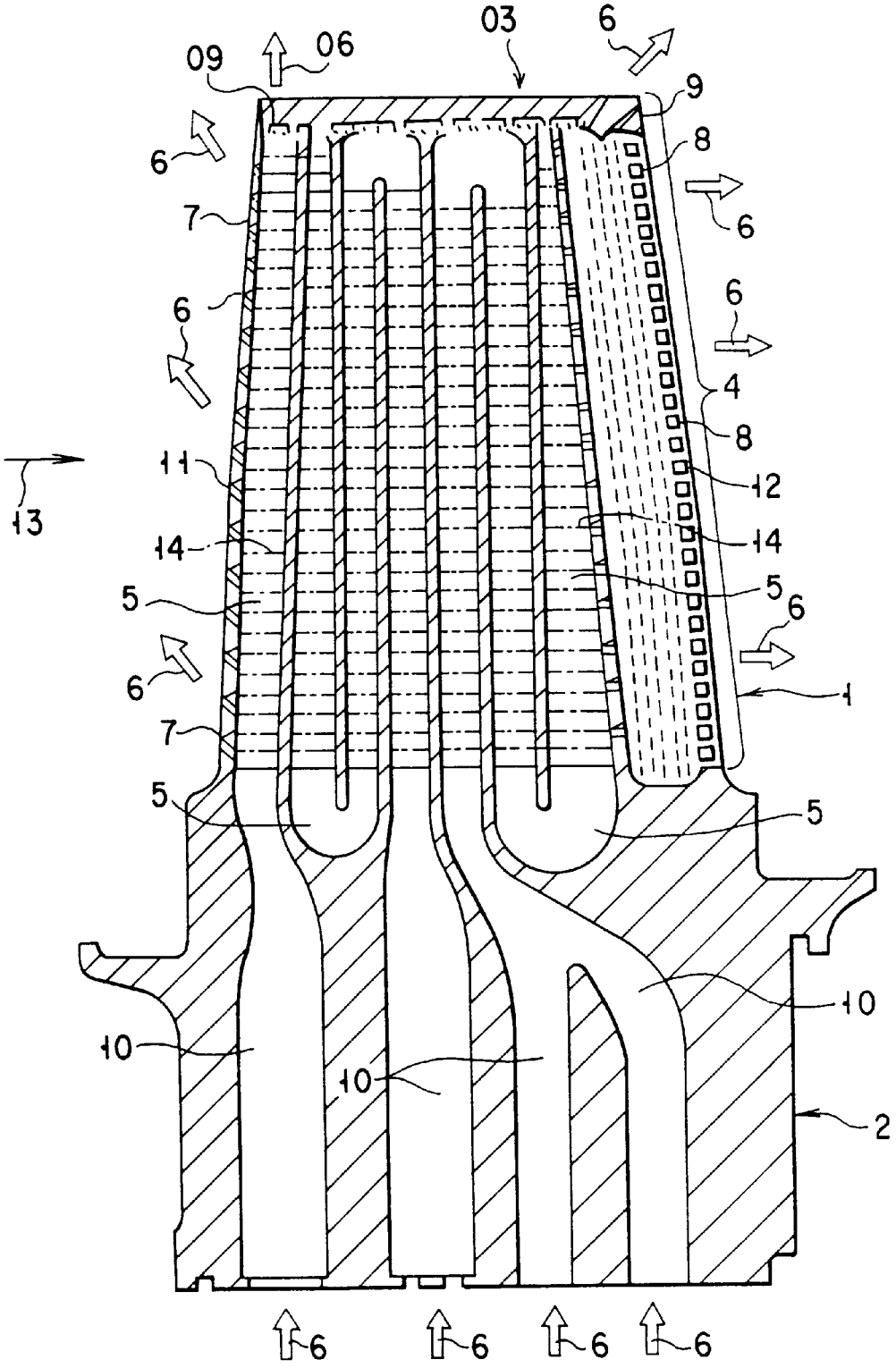
FIG. 1 PRIOR ART
FIG. 1 is a vertical sectional view of a conventional gas turbine blade cooled by means of cooling air.

Turbulators, like the ones shown in FIG. 1, are arranged in the cooling passages 5 so as to cross the flow of the steam 6. The turbulators serve to make the steam flow in the passages 5 turbulent, thereby improving the cooling efficiency.

The cooling passages 5 are arranged in a plurality of rows in the transverse direction or chord direction from the leading edge of the moving blade 1 toward the trailing edge, and are planted in the outer peripheral surface of a blade root section 2. Some of the low-temperature steam 6 introduced into a supply-side passage 10 through a steam passage 15 in a rotor (not shown) flows through a leading-edge-side cooling passage 51 on a leading edge side 11, among the other cooling passages 5, toward a blade tip section 3. The supply-side passage 10 is provided in the leading edge side 11 of the blade root section 2. The aforesaid portion of the low-temperature steam 6 flows through the cooling passages 5 behind the passage 51 toward the blade root section 2. Thus, the inside of the moving blade 1 is subjected to convection cooling by means of some of the low-temperature steam 6.

The steam 6, having made a stroke through the cooling passages 5 between the blade root section 2 and the blade tip section 3, flows out through a discharge-side passage 16 in the root section 2 into a steam passage 17. The passage 17, which is bored through the rotor, is cut off from the supply-side passage 10.

The other portion of the low-temperature steam 6 introduced into the supply-side passage 10 flows to the trailing edge side 12 through a connecting hole 18 in the passage 10 and a pocket 19 (mentioned later). The other portion of the steam 6 delivered to the trailing edge side 12 flows through a connecting hole 20 into a trailing-edge-side passage 52 in the trailing edge side 12, among the other cooling passages 5.

The low-temperature steam introduced into the trailing-edge-side passage 52 flows through the passage 52 to the blade tip section 3, whereupon it turns. The low-temperature steam turned at the tip section 3 flows through the cooling passages 5 in front of the passage 52 toward the blade root section 2. Thus, the inside of the moving blade 1 is subjected to convection cooling by means of some of the low-temperature steam introduced into the trailing-edge-side passage 52.

Further, the steam 6 makes a stroke through the cooling passages 5 between the blade root section 2 and the blade tip section 3. After thus making a stroke, the steam 6 flows out through the discharge-side passage 16 in the root section 2 into the steam passage 17 that is cut off from the supply-side passage 10. The passage 17 is bored through the rotor.

Figure 3:
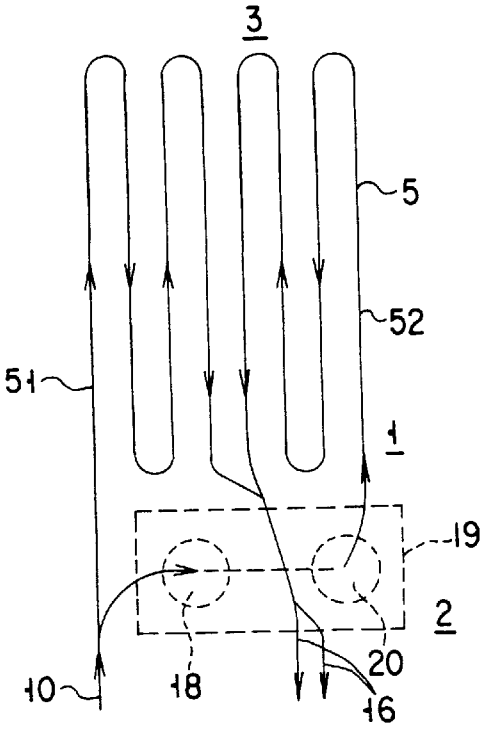
FIG. 3 is a diagram showing the relative positions of cooling passages, supply-side passage, discharge-side passage, and pocket and flows of a cooling medium.
Figure 5:
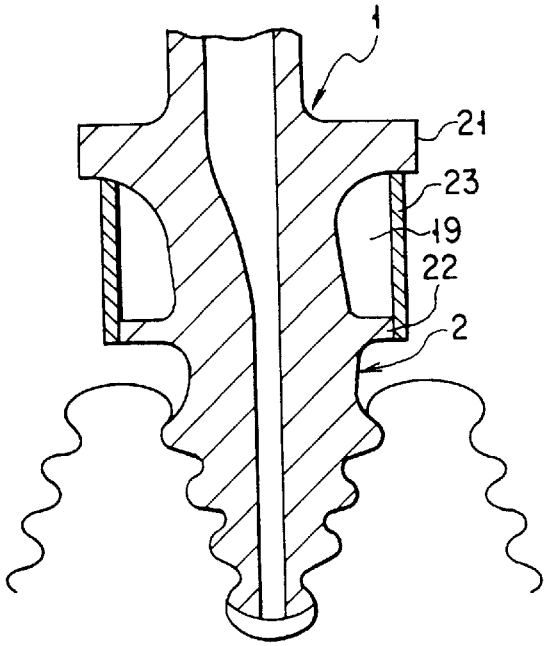
FIG. 5 is a partial sectional view taken along line B—B of FIG. 2.
Figure 4:
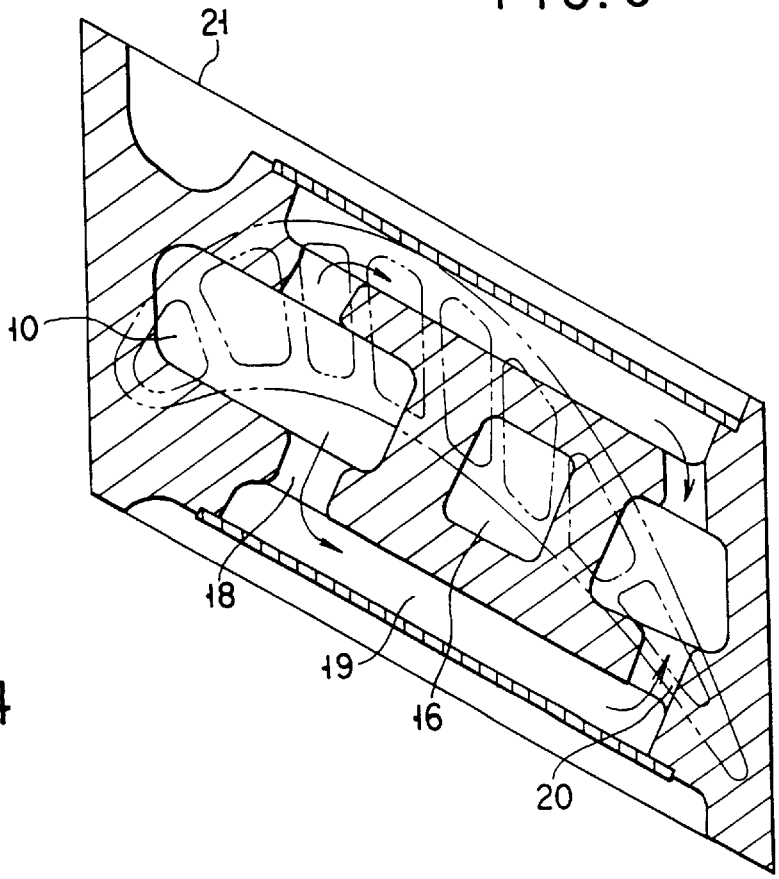
FIG. 4 is a sectional view taken along line A—A of FIG. 2.

As shown in FIGS. 3 and 4, the pocket 19 is composed of a blade platform 21 and a turbine wheel plate 22 that protrude from the side face of the blade root section 2. The pocket 19 is a passage that is formed in the side face of the root section 2 by enclosing the lower end portion of the platform 21 and the outer surface of the wheel plate 22 with a plate 23, and extends from the leading edge portion 11 toward the trailing edge portion 12.

Referring again to FIG. 2, the leading edge portion 11 of the pocket 19 is connected to the supply-side passage 10 through the casing hole 18 in the side face of the blade root section 2. The trailing edge portion 12 of the pocket 19 is connected to the trailing-edge-side cooling passage 52 through the connecting hole 20 in the side face of the root section 2.

In the gas turbine blade according to the present embodiment described above, some of the steam 6 supplied to supply-side passage 10 is introduced into the leading-edge-side cooling passage 51, as shown in FIG. 3. The other portion of the steam 6 passes through the connecting hole 18 in the side face of the blade root section 2, flows through the cross pocket 19 between the blade platform 21 and the outer periphery of the turbine wheel plate 22, and gets into the trailing-edge-side cooling passage 52 through the connecting hole 20 in the side face of the root section 2 on the trailing edge side. In this manner, the leading and trailing edge sides 11 and 12 of the moving blade 1 under high heat load is effectively cooled by means of the low-temperature steam 6, whereby it can be prevented from being heated to high temperature.

After passing through the leading- and trailing-edge-side cooling passages 51 and 52, the steam 6 flows toward a blade trunk section 4, reciprocating in the cooling passages 5 that are arranged extending in the span direction, and is recovered through the discharge-side passage 16.

Thus, the low-temperature steam 6 is supplied directly to the leading-edge-side cooling passage 52 through the supply-side passage 10, simultaneously supplied by means of the pocket 19 to the leading and trailing edge sides 11 and 12 that are subject to high heat load, and then supplied to the central portion that is subject low heat load. Accordingly, the cooling efficiency is improved, and the leading and trailing edge sides 11 and 12, which are poor in structural strength, can be prevented from being heated to high temperature without using a film-cooled structure. Since a gas of higher temperature can be used as an operating gas, moreover, the thermal efficiency of the gas turbine can be enhanced.

According to the present embodiment, furthermore, the leading edge side 11 of the moving blade 1 can be cooled without undergoing film cooling, so that the high-temperature operating gas need not be cooled by discharging the steam 6 into it. While the cooling causes heat energy to accumulate in the steam 6, this accumulated energy can actuate a steam turbine or the like, thereby generating power superfluously. Accordingly, the thermal efficiency of the gas turbine can be improved considerably.

Further, the blade root section 2 must be provided with only the supply-side passage 10 of one system inside. Therefore, it is unnecessary positively to arrange the supply- and discharge-side passages 10 and 16 with wide flow areas in the small-capacity blade root section. In consequence, the construction is simplified.

According to the gas turbine blade of the present invention, as described above, the used cooling medium can be recovered without being discharged into the high-temperature operating gas. Besides, the cooling steam is first supplied to the high-load portion of the moving blade and then recovered from the low-load portion. Thus, the cooling efficiency is so high that the leading and trailing edge portions, which are poor in high-temperature strength, can be prevented from being heated to high temperature. At the same time, the gas turbine efficiency can be improved substantially.

Further, the construction of the blade root section can be simplified, the manufacturing cost can be reduced, and the reliability of the gas turbine blade can be improved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A gas turbine blade including a blade trunk section, a blade root section, a platform, and a blade wheel plate, the blade comprising:

cooling passages, arranged in the blade trunk section, for cooling the blade trunk section, the cooling passages being connected to one another to form a single passage and including at least a supply-side passage and a discharge-side passage;

a cooling medium supply passage, arranged in the blade root section and connected to the supply-side passage, for supplying a cooling medium to the cooling passages;

a pocket, arranged in the blade root section and connected between the cooling medium supply passage and one of the cooling passages other than the supply-side passage and the discharge-side passage, for bypassing the cooling medium to be supplied to the supply-side passage to the one of the cooling passages other than the supply-side passage and the discharge-side passage, the pocket being formed by interposing a plate between the platform and the blade wheel plate; and a cooling medium discharge passage, arranged in the blade root section and connected to the discharge-side passage, for discharging the cooling medium flowed through the cooling passages.

2. A gas turbine blade according to claim 1, wherein the pocket is formed on the inside of the blade root section.

3. A gas turbine blade including a blade trunk section, a blade root section, a platform, and a blade wheel plate, the blade comprising:

cooling passages, arranged in the blade trunk section, for cooling the blade trunk section, the cooling passages being connected to one another to form a single passage and including at least a supply-side passage and a discharge-side passage;

a cooling medium supply passage, arranged in the blade root section and connected to the supply-side passage, for supplying a cooling medium to the cooling passages;

a pocket, arranged on the outside of the blade root section and connected between the cooling medium supply passage and one of the cooling passages other than the supply-side passage and the discharge-side passage, for bypassing the cooling medium to be supplied to the supply-side passage to the one of the cooling passages other than the supply-side passage and the discharge-side passage, the pocket being formed by interposing a plate between the platform and the blade wheel plate; and a cooling medium discharge passage, arranged in the blade root section and connected to the discharge-side passage, for discharging the cooling medium flowed through the cooling passages.

4. A gas turbine blade according to claim 1 or 3, wherein the cooling medium supply passage includes a branch portion, one branch of the branch portion being connected to one of the cooling passages and another branch being connected to the pocket.

5. A gas turbine blade including a blade trunk section, a blade root section, a platform, and a blade wheel plate, the blade comprising:

cooling passages, arranged in the blade trunk section, for cooling the blade trunk section, the cooling passages being connected to one another to form a single passage and including at least a supply-side passage and a discharge-side passage;

a plurality of pockets, arranged in the blade root section and connected between a cooling medium supply passage and one of the cooling passages other then the supply-side passage and the discharge-side passage, for bypassing the cooling medium to be supplied to the supply-side passage to the one of the cooling passages other than the supply-side passage and the discharge-side passage, the pockets being formed by interposing plates between the platform and the blade wheel plate; and a cooling medium discharge passage, arranged in the blade root section and connected to the discharge-side passage, for discharging the cooling medium flowed through the cooling passages.

6. A gas turbine blade according to claim 1, 3 or 5, wherein the cooling medium supply passage and the cooling medium discharge passage are not connected directly to each other.

7. A gas turbine blade according to claim 1, 3 or 5, wherein the supply-side passage connected to the cooling medium supply passage is formed in a front blade portion of the blade trunk section.

8. A gas turbine blade according to claim 1, 3 or 5, wherein the discharge-side passage connected to the cooling medium discharge passage is formed in a rear blade portion of the blade trunk section.

9. A gas turbine blade according to claim 1, 3 or 5, wherein the cooling medium discharge passage is connected to one of the cooling passages formed in a central portion of the blade trunk section.

10. A gas turbine blade according to claim 1, 3 or 5, wherein the cooling passages are arranged in a plurality of rows and have turn portions at a blade tip section of the blade trunk section.

11. A gas turbine blade according to claim 1, 3 or 5, wherein the cooling medium is steam.

* * * * *